US006004193A

United States Patent [19]

Nagahara et al.

[11] Patent Number: 6,004,193

[45] Date of Patent: Dec. 21, 1999

[54] DUAL PURPOSE RETAINING RING AND POLISHING PAD CONDITIONER

[75] Inventors: Ron J. Nagahara; Dawn M. Lee, both of San Jose, Calif.

[73] Assignee: LSI Logic Corporation, Milpitas, Calif.

[21] Appl. No.: 08/895,960

[22] Filed: Jul. 17, 1997

[51] Int. Cl.[6] ..... B24B 5/00

[52] U.S. Cl. ..... 451/285; 451/56; 451/443; 451/288

[58] Field of Search ..... 451/41, 56, 63, 451/443, 444, 285, 287, 288

[56] References Cited

U.S. PATENT DOCUMENTS

| | | | |
|---|---|---|---|
| 4,490,948 | 1/1985 | Hanstein et al. . | |
| 5,340,370 | 8/1994 | Cadien et al. . | |
| 5,377,451 | 1/1995 | Leoni et al. . | |
| 5,421,769 | 6/1995 | Schultz et al. . | |
| 5,531,635 | 7/1996 | Mogi et al. | 451/56 |
| 5,536,202 | 7/1996 | Appel et al. . | |
| 5,554,064 | 9/1996 | Breivogel et al. . | |
| 5,569,062 | 10/1996 | Karlsrud | 451/56 |
| 5,643,067 | 7/1997 | Katsuoka et al. | 451/444 |
| 5,658,185 | 8/1997 | Morgan, III et al. . | |
| 5,679,063 | 10/1997 | Kimura et al. . | |
| 5,681,212 | 10/1997 | Hayakawa et al. | 451/288 |
| 5,749,771 | 5/1998 | Isobe | 451/285 |

FOREIGN PATENT DOCUMENTS

| | | |
|---|---|---|
| 1-321161A | 12/1989 | Japan . |
| 2-100321A | 4/1990 | Japan . |

*Primary Examiner*—Eileen P. Morgan

[57] ABSTRACT

An apparatus is provided for conditioning a polishing pad used for chemical-mechanical polishing. The apparatus comprises the retainer ring used to retain the semiconductor wafer against the polishing pad. Accordingly, the retainer ring serves a dual purpose: to retain the wafer in proper CMP position as well as condition the polishing surface while polishing of the wafer. The retainer ring includes an inner surface defining an opening to receive the semiconductor wafer. Dimensioned radially outside the inner surface is an outer surface. Placed on the distal ends between the inner and outer surfaces is an abrasive surface. The abrasive surface extends along a plane parallel to the retained frontside surface of the wafer. Both the wafer and the abrasive surface contact the polishing surface either in a rotation about a stationary axis or orbital movement about that axis. The wafer surface can be pressed to a greater or lesser extent against the polishing pad independent of the pressure exerted by the abrasive surface on that pad radially outside the wafer.

18 Claims, 3 Drawing Sheets

DUAL PURPOSE RETAINING RING AND POLISHING PAD CONDITIONER

BACKGROUND OF THE INVENTION

1. Field of the Invention

This invention relates to chemical-mechanical polishing ("CMP") and, more particularly, to an apparatus for conditioning a polishing pad during CMP.

2. Description of Related Art

The concept of applying chemical and mechanical abrasion to a substrate is generally well known in the industry as CMP. A typical CMP process involves placing a substrate or, according to one specific application, semiconductor wafer face-down on a polishing pad which is fixedly attached to a rotatable table or platen. Elevationally extending portions of the downward-directed wafer surface contact with the rotating pad. A fluid-based chemical, often referred to as a "slurry" is deposited upon the pad possibly through a nozzle, whose distal opening is placed proximate the pad laterally offset from the wafer. The slurry extends at the interface between the pad and the wafer surface to initiate the polishing process by chemically reacting with the surface material being polished. The polishing pad is facilitated by the rotational movement of the pad relative to the wafer (or vice versa) to remove material catalyzed by the slurry.

The slurry can be made of numerous chemical species depending on the material being removed from the wafer surface. For example, the slurry can comprise silica, alumina or ceria particles entrained within, e.g., a potassium-based solvent. The solvent may include, for example, potassium hydroxide, potassium ferracyanide, potassium acetate or potassium fluoride diluted with deionized water. The amount of particulate in the solvent can be selected and sold under various trade names, a suitable source being Semi-Spurse® or Cab-O-Sperse®, manufactured by Cabot, Inc. Merely as an example, a preferred slurry composition for CMP of a tungsten film is a solution comprising approximately 0.1 molar potassium ferracyanide, approximately 5% by weight silica, with trace amounts of potassium acetate diluted with deionized water. A small amount of concentrated acetic acid is further included to adjust the pH of the tungsten slurry to a range between, e.g., 3.0 to 4.0. The above-referenced composition proves beneficial in removing tungsten from interlevel silicon dioxide layers.

The polishing pad can be made of various substances which can be both resilient and, to a lesser extend, conformal. The weight, density and hardness of the pad will vary depending on the material being removed from the wafer surface. A popular polishing pad comprises polyurethane which, in most instances, does not include an overlying fabric material. A somewhat hard polishing pad can be obtained as an IC-60 pad manufactured by Rodel Corporation, for example. A relatively soft pad can be obtained as a Polytech Supreme pad, also manufactured by Rodel Corp.

Use of both chemical and mechanical abrasion in a CMP environment is popular in most modern semiconductor wafer fabrication processes. For example, CMP is used to planarize tungsten-based interconnect plugs commensurate with the upper surface of the interlevel dielectric. The remaining tungsten is bounded exclusively within the interconnect regions which extend between levels of interconnect. As another example, CMP may be used to planarize fill dielectric placed in shallow trenches, the planarized fill dielectric is thereby used as a field dielectric. Accordingly, CMP is principally popular as a planarization tool.

CMP may be used several times throughout a modern semiconductor wafer fabrication process. Unfortunately, each time CMP is used, various items are "consumed". These items include the slurry and, more importantly, wear upon the polishing pad. The polishing pad is relatively expensive and after several CMP runs, must either be replaced or "conditioned".

Pad conditioning is typically performed by mechanically abraiding the pad surface in order to renew that surface. Most conditioning devices can renew the surface during wafer polish. Current conditioning processes involve placing a conditioning head with an abrasive surface over the polish pad in a region laterally displaced from the semiconductor wafer. As the polishing pad rotates, the conditioning head displaces the abrasive surface upon and within the polishing pad in the track through which the wafer extends. The abrasive surface contacting the polishing pad renews the surface by removing depleted slurry particles or polishing by-product embedded in the pores of the polishing pad. Opening the pores allow new slurry to enter the pores to enhance polishing therein. Additionally, the open pores provide more surface area for polishing.

If the pores remain blocked over a substantial period of time, a condition known as "glazing" occurs. Glazing is the result of enough particle build-up on the polishing pad surface that the wafer surface begins to hydroplane over the surface of the pad. Hydroplaning eventually result in substantially lower removal rates in the glazed areas.

An example in which a polishing pad is conditioned concurrent with wafer polishing is shown in FIG. 1. FIG. 1 provides a perspective view of a polishing pad 10 mounted on a rotatable platen 12. Platen 12 rotates about a central axis 14 along the direction shown by arrow 16. Platen 12, including pad 10, can be directed upward against wafer 18 (or vice versa). Wafer 18 is secured in a rotatable position about axis 20 by an arm 22. Wafer 18 is mounted such that the frontside surface extends against pad 10, the frontside surface embodying numerous topological features used in producing an integrated circuit. Wafer 18 rotates about axis 20 along arrow 24 within a plane parallel to the plane formed by the polishing surface of pad 10.

Wafer 18 occupies a portion of the polishing surface, denoted as a circular track 26 defined by the rotational movement of pad 10. Track 26 is conditioned during wafer polish by a conditioning head 28. Conditioning head 28 is mounted on a movable arm 30 which can swing in position along track 26 commensurate with arm 22. Arm 30 presses an abrasive surface of conditioning head 28 against the polishing surface of pad 10 predominantly within track 26 as pad 10 rotates about axis 14. During this process, protrusions on the abrasive, downward-facing surface of head 28 extend to the surface of polishing pad 10. This causes particles embedded in the pores of pad 10 to be removed from the pad and flushed with the slurry across the pad surface. As the slurry is introduced, the removed particles are rinsed over the edges of the polishing pad into a drain (not shown). Removing the particles from the polishing pad enables the depleted pad surface to be recharged with new slurry. FIG. 1 illustrates conditioning concurrent with wafer polishing. However, it is recognized that conventional conditioning can occur either before or after wafer polishing.

FIG. 2 illustrates a cross-sectional view of the CMP and conditioning process illustrated in FIG. 1. More specifically, FIG. 2 illustrates the abrasive surface 32 formed at the lower surface of conditioning head 28. Abrasive surface 32 extends as a plurality of protrusions interspersed with recesses. The protrusions and recesses can be spaced close together or farther apart depending on the porosity of pad 10. Surface 32 preferably contacts pad 10 surface commensurate with wafer 18. More particularly, abrasive surface 32 extends below the upper surface of slurry film 34 to dislodge depleted slurry particles and/or wafer polish by-product from pores of pad 10.

Concurrent pad conditioning with wafer polishing enhances the throughput of the CMP process. Little if any downtime is therefore associated with pad conditioning. Unfortunately, however, conditioning head 28 occupies area upon pad 10 which might better be used by additional semiconductor wafers. In other words, it would be desirable to further enhance CMP throughput by configuring multiple wafers across the polishing surface. Introduction of multiple wafers, however, would forgo the space needed for conventional conditioning. Yet further, it would be desirable to eliminate the conditioning head and the relatively costly mechanism for moving and aligning the head to the polishing track 26 upon the polishing surface. The additional mechanical components and abrasive surfaces afforded by conventional conditioning heads should be eliminated if cost minimization and throughput is to be enhanced.

Summary of the Invention

The problems outlined above are in large part solved by an improved conditioning apparatus and method hereof. The present conditioning apparatus is employed within a retainer ring which retains a substrate upon a polishing surface. Accordingly, the present retainer ring serves a dual purpose: to condition the polishing surface while retaining the substrate. According to one embodiment, the substrate can be a semiconductor wafer. However, it is recognized that the present polishing technique can be applied to a substrate not limited to a semiconductor wafer. Accordingly, whenever "wafer" is referenced hereinbelow, it applies to any material composition which can be polished and is configured as a wafer or disk. Thus, "wafer" refers to the shape of the item being polished and not necessarily to a semiconductor-type wafer. Thus, wafer includes any device manufactured having a defined thickness and diameter used, for example, in manufacturing or in trade, a suitable disk-shaped wafer includes, for example, a CD-ROM, etc.

The retainer ring comprises outer and inner surfaces regularly spaced from one another. The inner surface is dimensioned to retain the semiconductor wafer outer periphery. An orthogonal surface is placed perpendicular to the inner and outer surfaces at the distal ends of those surfaces. The orthogonal surface comprises an abrasive material. Accordingly, the orthogonal surface can be thought of as an abrasive surface which extends substantially parallel to the polishing surface and the wafer surface being polished. The abrasive surface extends radially outside of the semiconductor wafer. The inner surface may further comprise a mechanism for retaining a wafer carrier. The wafer carrier can be moved within the opening formed by the inner surface, either toward the polishing surface or away from the polishing surface independent of the abrasive surface. The backside surface of the wafer may be bonded to the carrier by, for example, a poromeric film, vacuum pressure or a thin layer of hot wax. The poromeric film, when wet, retains the wafer by surface tension against the carrier. The retaining ring prevents lateral movement of the wafer. Accordingly, the inner surface of the retaining ring is dimensioned in close proximity to the outer perimeter of the wafer being retained.

The abrasive surface may comprise a patterned silicon-based or carbon-based substance. The abrasive surface preferably comprises a plurality of protrusions spaced from one another within a silicon-based or carbon-based substance.

BRIEF DESCRIPTION OF THE DRAWINGS

Other objects and advantages of the invention will become apparent upon reading the following detailed description and upon reference to the accompanying drawings in which.

Figure 1:
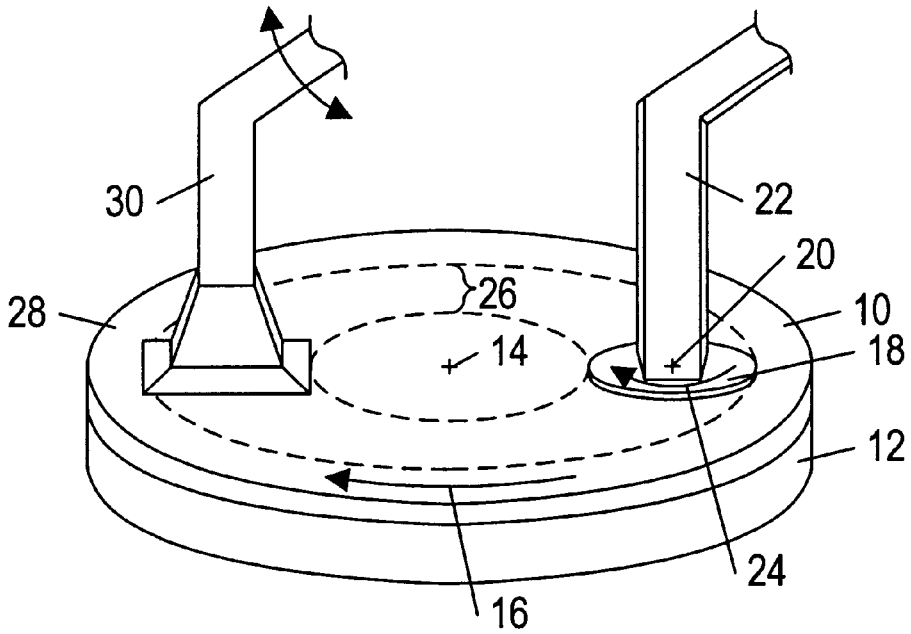
FIG. 1 (PRIOR ART)
FIG. 1 is a perspective view of a CMP system employing a conditioning head offset from a semiconductor wafer being polished according to a conventional technique.
Figure 2:
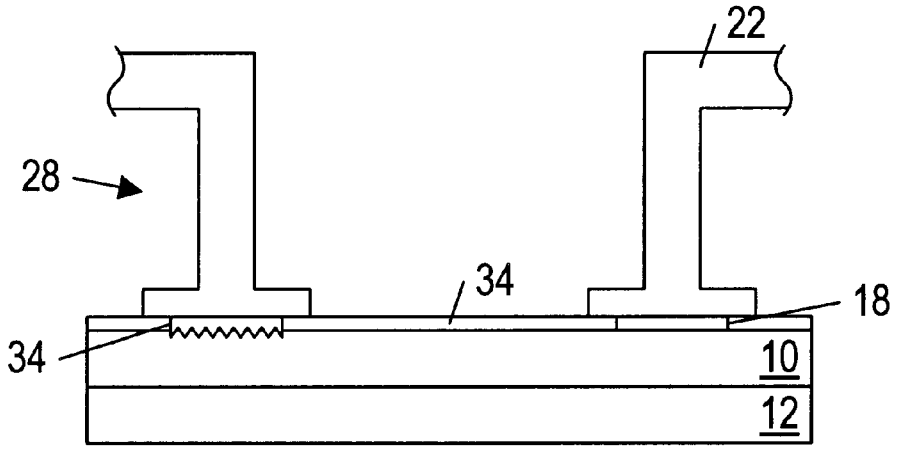
FIG. 2 (PRIOR ART)
FIG. 2 is a cross-sectional view of the CMP system shown in FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Detailed Description of Preferred Embodiments

Figure 3:
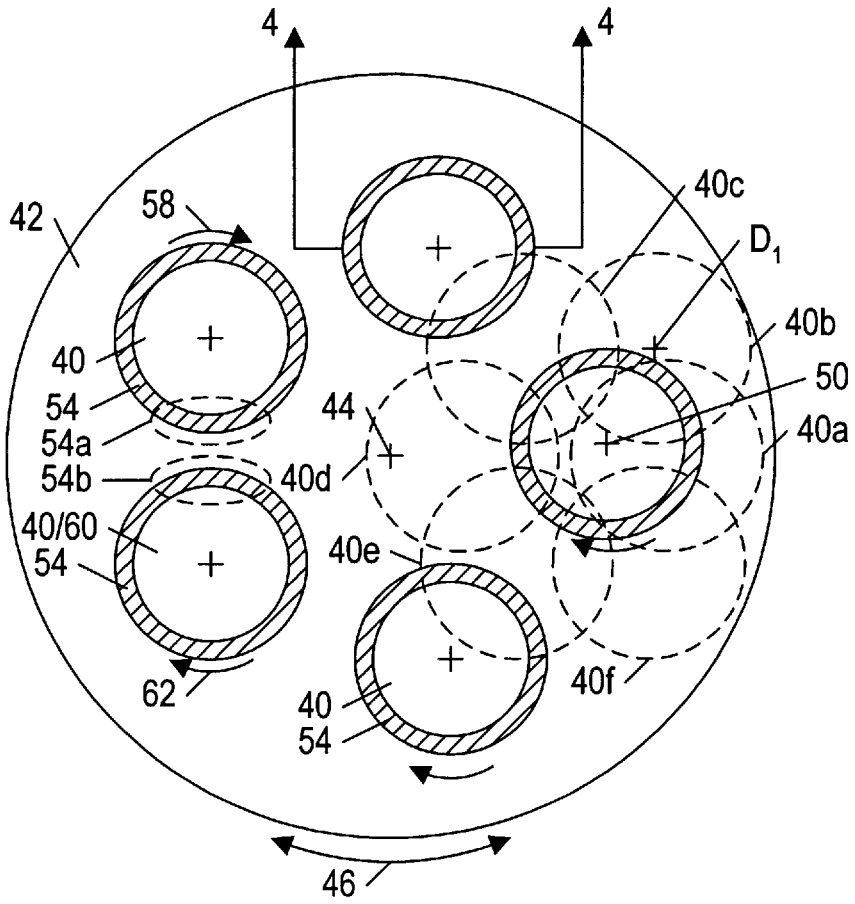
FIG. 3 is a top plan view of one or more semiconductor wafers retained within an abraided retainer ring and placed upon a rotatable polishing pad according to an embodiment of the present invention.

Turning now to the drawings, FIG. 3 illustrates a top plan view of one or more semiconductor wafers 40 arranged about the upper surface of a rotatable polishing pad 42. Polishing pad 42 may rotate about a central axis 44 either in the clockwise or counterclockwise direction. The variable angle of rotation is shown as reference numeral 46. Pad 42 rotates such that an upper polishing surface retains a planar position relative to the frontside surfaces of wafer 40. Polishing pad 42 comprises any surface, either hard or soft surface, which can mechanically abrade the targeted substance on the frontside surface of wafers 40. As an example, polishing pad 42 comprises polyurethane, suitable for removing layers of, e.g., silicon dioxide ("oxide") or tungsten.

Wafers 40 are spaced from one another about central axis 44. According to a preferred embodiment, wafers 40 may oscillate or orbit about a focal point 50. In the alternative, wafers 40 may rotate about a stationary axis 50. When orbiting, each wafer 40 orbits within a plane parallel to the polishing surface a radial distance $D_1$ about focal point 50. The angular rotation is relatively constant, in either a clockwise or counterclockwise direction. According to one example, the wafer may begin at position 40*a* and orbit until it obtains position 40*b*,then 40*c* and eventually through 40*f* to again reside at 40*a*. Each wafer 40, about pad 42, orbits at the same angular direction and at the same angular velocity to ensure the wafers do not contact one another.

The purpose of the orbital movement about various focal points 50 spaced from the central axis 44 is mostly derived from the mechanism of the present conditioning process.

Specifically, conditioning occurs concurrent with wafer polishing via the abrasive surface (or surfaces 54) arranged about the periphery of each wafer 40. By orbiting wafers 40 commensurate with surfaces 54, more of the pads polishing surface is used. In other words, polishing is not limited to a particular track about central axis 44. Instead, the track width can be substantially increased to encompass almost the entire pad surface. This not only enhances the longevity of the pad but also ensures replenishment or conditioning of almost the entire pad. In summary, wafers 40 and surfaces 54 orbit about a stationary focal point 50. Focal point 50 is stationary relative to the rotating pad 42. Depending on the number of wafers and surfaces, there is a corresponding number of focal points for each wafer and surface. It is desired that as many wafers be placed on the pad as possible to enhance throughput of CMP. FIG. 3 illustrates only five wafers merely as an example.

It is recognized that, as an alternative, each wafer may rotate about focal point 50. In this embodiment, wafers 40 and surfaces 54 do not orbit but, instead, rotate about their respective focal points. This lessens the polishing surface of pad 42 being used by narrowing the polishing track. Nonetheless, suitable polishing can occur since the polishing surface has been preconditioned by the lagging, abrasive surface of a preceding wafer retainer and the leading abrasive surface of the present wafer retainer. To illustrate this point, one can assume a counterclockwise rotation of polishing pad 42. This presents an abrasive surface 54*a* which pre-conditions the polishing surface in a clockwise direction 58 prior to the polishing surface reaching wafer denoted as 40/60. Beneficially, another abrasive surface 54*b* rotates in direction 62 such that it brushes the track of the polishing surface opposite that which surface 54*a* brushes the pad. This helps to dislodge particles from pores which may be resilient in one direction but not the other. Accordingly, the pad is preconditioned by abraiding it in both directions perpendicular to the track rotation prior to it contacting a wafer such as that denoted by reference numeral 40/60.

It is therefore appreciated that rotation about a stationary axis or orbital movement about that axis enhances conditioning of the pad surface and polishing of possibly numerous wafers.

Figure 4:
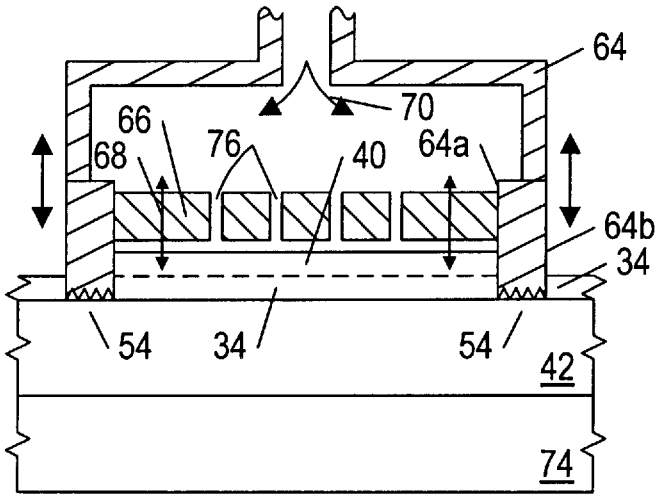
FIG. 4 is a cross-sectional view along plane 4 of FIG. 3.

Turning now to FIG. 4, a cross-sectional view along plane 4 of FIG. 3 is shown. Specifically, the dual purpose retainer ring and conditioner is shown. Advantageously, the mechanism used to place a wafer against a polishing surface can also be used to place a conditioning surface against the polishing surface. Thus, two separate mechanisms are not required as in conventional designs.

FIG. 4 illustrates a retainer ring 64 having an inner surface 64*a* and an outer surface 64*b*. Inner surface 64*a* defines an opening through which a wafer carrier 66 can be arranged. Wafer carrier 66 slides back and forth across inner surface 64*a* depending on the pressure being exerted on the backside surface of carrier 66. The frontside surface of carrier 66 accommodates a wafer 40.

Carrier 66 is fixed to retainer 64 except for the independent up and down motion 68 of carrier 66 relative to retainer 64. Otherwise, carrier 66 rotates or orbits with retainer 64. Carrier 66 can be forced downward 68 against the backside surface of wafer 40 whenever substantial air pressure 70 is placed into a chamber above carrier 66. Air pressure is only one mechanism with which to independently move carrier 66 in a vertical direction relative to retainer 64. There may be, of course, numerous other mechanisms, all which fall within the spirit of the present invention. The benefit of moving carrier 66 relative to retainer 64 is to independently control the amount of polishing of frontside surface of wafer 40 relative to conditioning of the pad. Greater downward force applied on carrier 66 relative to force applied to retainer 64 translates to wafer 40, causing a greater polish rate relative to conditioning of the pad. Conditioning of the pad occurs via abrasive surfaces 54 placed along an orthogonal surface arranged between distal ends of inner and outer surfaces 64*a* and 64*b*. Abrasive surfaces 54 dislodge particles embedded in polishing pad 42 as pad 42 is fixedly secured to a rotatable platen 74. Platen 74 is shown in FIG. 3 to rotate about central axis 44.

Abrasive surfaces 54 extend beneath the upper surface of a slurry film 34 and contact the upper surface of pad 42. Slurry can be made of any material necessary to enhance mechanical abrasion as well as provide chemical abrasion. Slurry is applied either upward through pad 42 or above the pad surface by a dispensing nozzle. Slurry 34 preferably comprises an etching or oxidizing agent such as a potassium-based chemical containing silica particles, diluted in deionized water and possibly further containing a buffer agent or an acid agent to adjust the pH.

The backside surface of wafer 40 is secured to the frontside surface of carrier 66 by various mechanical means, such as vacuum pressure through port openings 76 within carrier 66, or by adhesives, wax or poromeric film and/or surface tension if port openings 76 are absent. The inner surface 64*a* of retainer 64 is dimensioned relatively close, less than, e.g., several hundred microns outside the outer edge of wafer 66 to retain wafer 66 against lateral movement. Abrasive surface 54 comprises any silicon and/or carbon-based material patterned with spaced protrusions on one surface of the material film. The other surface of material film can be securely bonded to retainer 64, suitably made from a metallic substance. According to a preferred embodiment, abrasive surface 54 comprises silicon carbide or abrasive diamond studs.

Figure 5:
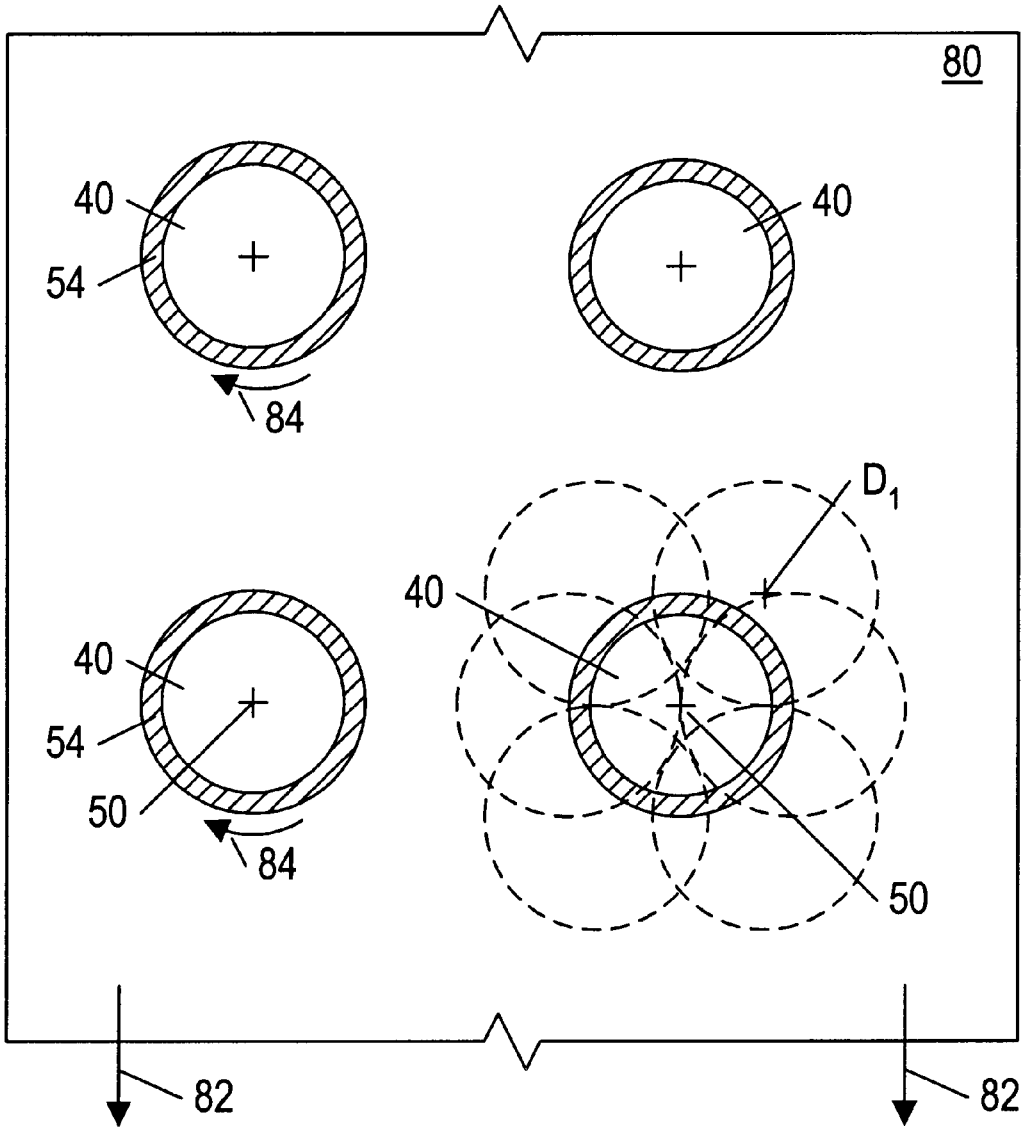
FIG. 5 is a top plan view of one or more semiconductor wafers retained within an abraded retainer ring and placed upon a linear moveable polishing pad according to another embodiment of the present invention.

Turning now to FIG. 5, a top plan view of various semiconductor wafers 40 retained upon a linear moving polishing pad is shown according to an alternative embodiment. Thus, instead of placing wafers on a rotatable polishing pad, the polishing pad can directed in a linear motion, possibly along a belt. The belt surface can comprise a polyurethane or fabric-covered polyurethane surface to form pad 80 which moves in a direction 82 relative to wafers 40.

Similar to the movement shown in FIG. 3, wafers 40 and abrasive surfaces 54 shown in FIG. 5 can either orbit or rotate about their respective focal points 50. If rotation is desired, the angle of rotation is shown as reference numerals 84. If orbiting is desired, the radius of angular orbit is shown as $D_1$.

A linear moving polishing pad 80 provides some advantages in that additional conditioning can occur distal from wafer 40 locations. For example, a conditioning head may be located away from wafers 40 in addition to abrasive surfaces 54. The additional conditioning head may possibly be configured in locations where the pad upper surface is inverted during the return of the pad surface to its utilized position along the continuous belt. Regardless of the pad configuration and methodology of presenting the polishing surface, it is recognized that a polishing pad beyond a circular pad may be used with the present dual purpose retainer ring. A linear moving belt pad may be one of many numerous alternative configurations.

It will be appreciated to those skilled in the art having the benefit of this disclosure that this invention is believed to be capable of removing material and/or film from an upper surface of a semiconductor wafer. It is intended that the following claims be interpreted to embrace all such modifications and changes and, accordingly, the specification and drawings are to be regarded in an illustrative rather than a restrictive sense.

What is claimed is:

1. An apparatus for retaining a semiconductor wafer against a polishing pad, the apparatus comprising:

a retaining ring having an inner surface for retaining the wafer while polishing and having an outer surface and comprising an orthogonal surface arranged substantially perpendicular to the inner surface;

said inner surface defines an opening adapted for receiving the semiconductor wafer and a wafer carrier; and said orthogonal surface comprises an abrasive material extending along the orthogonal surface said wafer carrier is configured to hold said semiconductor wafer, wherein said wafer carrier is movable within said opening.

2. The apparatus as recited in claim 1, wherein said orthogonal surface extends along a plane parallel to one surface of the semiconductor wafer.

3. The apparatus as recited in claim 1, wherein said orthogonal surface extends radially outside a perimeter of the semiconductor wafer.

4. The apparatus as recited in claim 1, wherein said retaining ring extends about a central axis between the inner surface and an outer surface displaced from the inner surface a radial distance relative to the central axis.

5. The apparatus as recited in claim 4, wherein said orthogonal surface extends between the outer and inner surfaces of said retaining ring.

6. The apparatus as recited in claim 1, wherein the said abrasive material comprises a patterned, silicon-based or carbon-based substance.

7. The apparatus as recited in claim 6, wherein said abrasive material comprises two sides substantially perpendicular to said inner side of said retaining ring, wherein one of said two sides is fixed to the orthogonal surface of the retaining ring and the other surface of said two sides comprises a plurality of protrusions interspersed with a plurality of recesses.

8. A chemical-mechanical polishing apparatus comprising:

a polishing pad having a moveable polishing surface;

a retaining ring having an outer and inner surface radially displaced from each other about a central axis, wherein the inner surface is adapted to retain a semiconductor wafer while polishing and defines an opening adapted to receive the semiconductor wafer; and an abrasive surface extending orthogonally between the outer and inner surfaces of said retaining ring, wherein the abrasive surface is adapted to contact the moveable polishing surface of said polishing pad wherein said abrasive surface extends towards said polishing surface independent of a spacing between the semiconductor and the polishing surface.

9. The apparatus as recited in claim 8, wherein said abrasive surface extends within a plane parallel to the polishing surface and a surface of the semiconductor wafer.

10. The apparatus as recited in claim 8, wherein said abrasive surface extends within a plane parallel to and between the polishing surface and a surface of the semiconductor wafer.

11. The apparatus as recited in claim 8, wherein said abrasive surface rotates about said central axis within a plane parallel to the polishing surface.

12. The apparatus as recited in claim 8, wherein the abrasive surface orbits within a plane parallel to the polishing surface.

13. The apparatus as recited in claim 12, wherein the abrasive surface orbits within said plane a radial distance $D_1$ about a point.

14. The apparatus as recited in claim 13, wherein distance $D_1$ exceeds one-third of the radial extent of the semiconductor wafer.

15. The apparatus as recited in claim 8, further comprising another retaining ring adapted to receive another semiconductor wafer, wherein said another retaining ring includes an associated another abrasive surface adapted to contact the polishing surface.

16. The apparatus as recited in claim 15, wherein said abrasive surface and said another abrasive surface are displaced laterally from each other across the polishing surface.

17. The apparatus as recited in claim 8, wherein said abrasive surface extends radially outside a perimeter of the semiconductor wafer.

18. The apparatus as recited in claim 8, wherein said polishing surface rotates about an axis parallel to and spaced from the central axis.

* * * * *